United States Patent [19]

Yates

[11] 4,273,500

[45] Jun. 16, 1981

[54] LOW PROFILE LIFT ATTACHMENT FOR A FORKLIFT

[76] Inventor: George A. Yates, 111 Woodlawn Ave., Grove City, Ohio 43123

[21] Appl. No.: 941,229

[22] Filed: Sep. 11, 1978

[51] Int. Cl.[3] ..... B66B 9/20

[52] U.S. Cl. ..... 414/642; 187/9 E; 187/95

[58] Field of Search ..... 414/639–642, 414/592, 785; 187/9 R, 9 E, 95; 280/490 R, 490 A, 461 A

[56] References Cited

U.S. PATENT DOCUMENTS

| | | | |
|---|---|---|---|
| 1,002,514 | 9/1911 | Hatfield | 187/95 X |
| 1,839,127 | 12/1931 | Stevelman | 187/95 |
| 2,541,268 | 2/1951 | Milz | 414/641 |
| 2,620,718 | 12/1952 | Oerman | 280/490 R |
| 2,747,689 | 5/1956 | Abbe | 187/9 E |
| 3,115,261 | 12/1963 | Antonelli | 414/607 |
| 3,312,361 | 4/1967 | Foster | 414/698 X |
| 3,458,069 | 7/1969 | Wickberg et al. | 414/722 |
| 3,706,388 | 12/1972 | Westendorf | 414/724 |

FOREIGN PATENT DOCUMENTS

| | | | |
|---|---|---|---|
| 726707 | 12/1966 | Italy | 187/9 E |
| 788021 | 12/1957 | United Kingdom | 414/639 |

*Primary Examiner*—Stephen G. Kunin

*Assistant Examiner*—Edmond G. Rishell, Jr.

*Attorney, Agent, or Firm*—Stanley J. Price, Jr.; John M. Adams

[57] ABSTRACT

A forklift assembly is pivotally connected to the front end portion of a self-propelled mobile frame. A mounting plate extends transversely across the front end portion of the mobile frame. A hydraulic lift cylinder is bolted to the intermediate portion of the mounting plate closely adjacent to the front axles of the mobile frame, and the piston rod of the lift cylinder is pinned to a lug extending rearwardly from the forklift assembly. Extension and retraction of the piston rod raises and lowers the forklift assembly relative to the mobile frame. The lug is connected to the piston rod to permit movement of the lug on a shoulder portion of the piston rod so that the torsional forces exerted on the forklift assembly are not transferred to the piston rod of the lift cylinder. Guide members are secured to the rear of the forklift assembly and the mounting plate to maintain vertical movement of the lift cylinder relative to the mounting plate. The forklift assembly is tilted forwardly or backwardly by tilt cylinders extending from the mobile frame. By positioning the lift cylinder closely adjacent to the front axles, the load carried by the forklift assembly is positioned as close as possible to the front axles to improve the stability of the machine particularly during tramming.

11 Claims, 7 Drawing Figures

LOW PROFILE LIFT ATTACHMENT FOR A FORKLIFT

BACKGROUND OF THE INVENTION

1. Field of the Invention

This invention relates to a materials handling machine and more particularly to a self-propelled forklift machine having improved front end stability for carrying heavy loads as encountered in hauling materials and equipment in underground mining operations.

2. Description of the Prior Art

Materials handling machines, such as forklift units are well known in the art for transporting heavy loads by a forklift unit pivotally connected by boom arms and powered by hydraulic tilt cylinders to the front end portion of a self-propelled tractor or the like. U.S. Pat. No. 3,115,261, 3,312,361, 3,458,069 and 3,706,388 are illustrative of this type and are adapted for use with earth moving tractors. Also it is known to utilize a hydraulic lift cylinder for vertically raising and lowering the forklift unit relative to the mobile frame. With this arrangement, the tines in a lowered position are advanced by tramming the machine into position to receive the load. Thereafter, the loaded unit may be moved vertically and tilted backwardly for positioning the load for tramming.

One problem encountered in carrying loads by a forklift unit is the load limitation which the unit can carry because of the torsional loads which are imposed by a loaded forklift unit on the piston rod of the lift cylinder. If the loads become excessive, the forces exerted upon the piston rod can bend the piston rod in the cylinder or destroy the packing around the piston rod which causes the cylinder to leak and a reduction in lifting capability of the cylinder.

In addition, as encountered with maneuvering heavy loads by a self-propelled forklift unit, the mobile frame becomes unstable. This occurs primarily when a heavy load is carried too far forward of the front axle, placing a moment on the front end of the frame and reducing the stability of the load. In some cases the traction of the rear wheels on the roadway is reduced by placing a heavy load on the forklift unit. This is particularly the case for vehicles of long longitudinal dimension.

In underground mining operations a number of lifting and hauling operations are encountered in moving equipment and materials throughout the mine. For example in moving longwall mining equipment from panel to panel in the mine requires substantial time in order to disassemble, move and reassemble the longwall unit. Items such as cribbing, hydraulic props, face conveyor components, shield type supports and the like varying in weight from a few tons to many tons must be moved. Due to the confined working area of a mine, the means for transporting the items must be easily maneuverable and highly stable.

While it has been suggested by the prior art to utilize forklift units for large material handling operations, there is need for a forklift type materials handling machine adaptable for use in underground mining operations where heavy loads can be transported without damage to the hydraulic lift cylinder and the load is positioned as close as possible to the front axles of the mobile frame.

SUMMARY OF THE INVENTION

In accordance with the present invention, there is provided a mobile materials handling machine that includes a mobile frame having a traction mechanism including a front axle positioned at a front end portion of the mobile frame. A mounting plate is pivotally connected to the mobile frame. The mounting plate extends transversely across the front end portion of the mobile frame. The mounting plate includes a pair of end portions and an intermediate portion therebetween. The pair of end portions are pivotally connected to the mobile frame to facilitate pivotal movement of the mounting plate about a transverse horizontal axis relative to the mobile frame. The intermediate portion is displaced rearwardly of the pair of end portions toward the mobile frame front end portion so that the intermediate portion is positioned closer to the front axle than the pair of end portions. A forklift assembly is positioned forwardly of the mounting plate and is connected to the mounting plate to facilitate vertical movement of the forklift relative to the mounting plate. A lift device is secured to the mounting plate intermediate portion and connected to the forklift assembly for selectively raising and lowering the forklift assembly relative to the mobile frame. The lift device is positioned between the forklift assembly and the mounting plate intermediate portion so that the lift device is located closely adjacent to the front axle to thereby closely position the load carried by the forklift assembly to the front axle.

Pivot actuating devices are secured to the mobile frame front end portion and connected to the mounting plate end portions for pivoting the mounting plate and the forklift assembly secured thereto about the transverse horizontal axis. With this arrangement once a load is placed on the forklift assembly and the assembly lifted to a preselected elevation, the pivot actuating devices are actuated to pivot the assembly rearwardly toward the mobile frame to a position to facilitate tramming of the mobile frame.

The mounting plate is connected by a pivot device to the front end portion of the mobile frame at a point below the connection of the pivot actuating devices to the front end portion of the mobile frame. A guide assembly is connected at one end to the mounting plate and at the opposite end to the forklift assembly to maintain vertical movement of the forklift assembly relative to the mounting plate and the mobile frame. With this arrangement the forklift assembly is independently movable vertically by actuation of the lift device and pivotally about the front end portion of the mobile frame by actuation of the pivot actuating devices. The guide assembly is operable to maintain vertical movement of the forklift assembly relative to the mounting plate to prevent torsional loads from being transferred from the forklift assembly to the lift device.

The lift device preferably includes a hydraulic piston cylinder assembly secured to the mounting plate intermediate portion. A piston rod is operable to extend and retract relative to the upper end of the piston cylinder assembly. The piston rod is connected to an attachment lug extending rearwardly from the mounting plate. The attachment lug includes a bore having a diameter greater than the diameter of the end of the piston rod to permit movement of the attachment lug on a supporting shoulder of the piston rod to assist in preventing the torsional forces carried by the forklift assembly from being transferred to the piston rod and the piston cylinder assembly. The piston rod is connected to the attachment lug to permit movement of the attachment lug on the piston rod shoulder.

Accordingly, the principal object of the present invention is to provide a mobile materials handling machine that includes a forklift assembly secured to a mobile frame in a manner to facilitate vertical and pivotal movement of the forklift assembly relative to the mobile frame.

Another object of the present invention is to provide a forklift assembly that is operable to be connected to a mobile frame in a manner where the forklift assembly is positioned closely adjacent to the front axle of the mobile frame to reduce the moment of the forces carried by the forklift assembly from being transferred to the front axle.

A further object of the present invention is to provide a forklift assembly mounted on a mobile frame in a manner to facilitate use of the forklift assembly in underground mining operations where the forklift assembly is operable to carry heavy loads and the stability of the mobile frame is maintained.

These and other objects of the present invention will be more completely disclosed and described in the following specification, accompanying drawings and appended claims.

DESCRIPTION OF PREFERRED EMBODIMENTS

Figure 1:
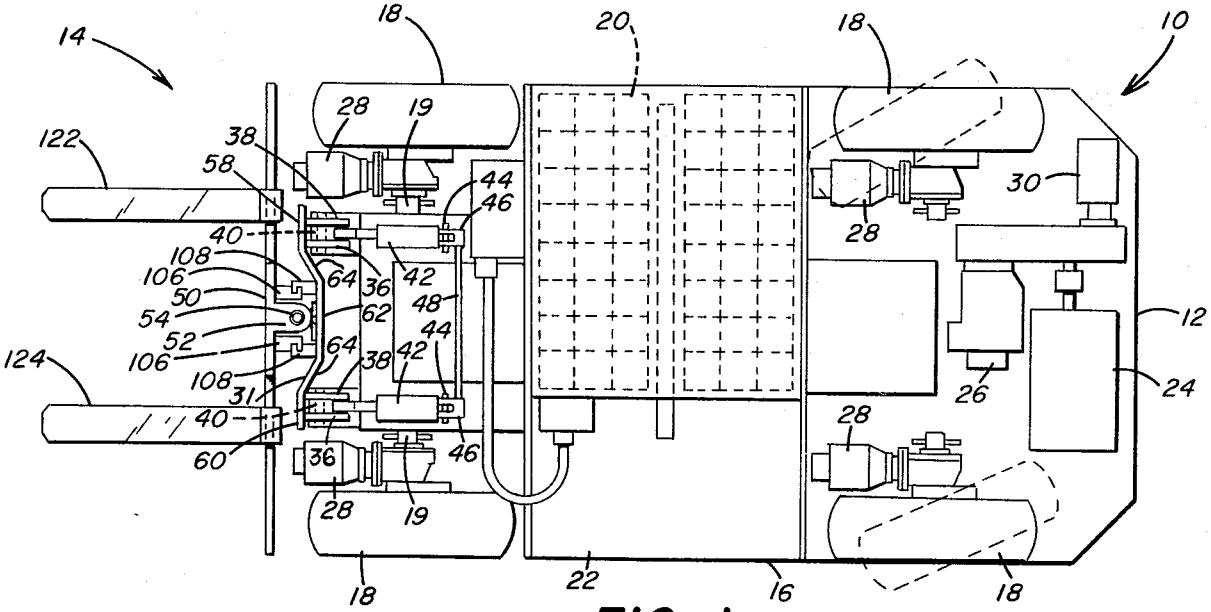
FIG. 1 is a top plan view of a forklift assembly mounted on the front end portion of a self-propelled frame.
Figure 2:
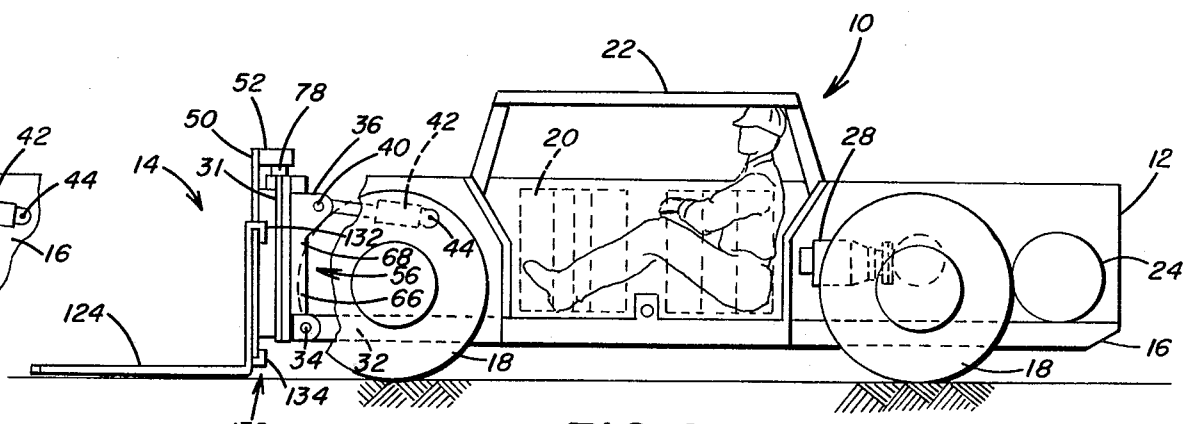
FIG. 2 is a view in side elevation of the forklift assembly and self-propelled frame shown in FIG. 1, illustrating the forklift assembly in a lowered position for receiving a load.
Figure 3:
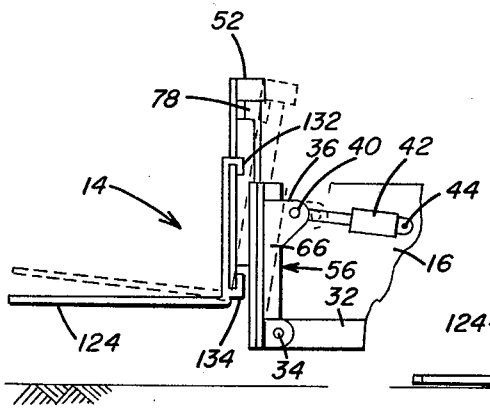
FIG. 3 is a fragmentary view of the forklift assembly shown in FIG. 1, illustrating the assembly in an elevated position for hauling or tramming and the assembly, as illustrated in phantom, pivoted rearwardly in the elevated position.

Referring to the drawings and, in particular to FIGS. 1, 2 and 3, there is illustrated a materials handling machine generally designated by the numeral 10. The machine 10 is comprised essentially of a transport unit 12 and a forklift assembly 14. Transport unit 12 may be any conventional tractor unit, crawler unit or other translatable frame unit.

A preferred transport unit 12, shown in FIGS. 1 and 2, is comprised of a chassis or frame 16 and wheels 18 and is powered by a bank or batteries 20. The batteries 20 are preferably located, as shown, between the front and rear wheels 18 adjacent the operator's compartment 22. Batteries 20 supply electric power to motor 24 which, in turn, drives a hydraulic pump 26 to supply fluid energy to the hydraulic motors 28 that provide independent tractive power to each wheel 18. The front wheels 18 are supported by front axles 19. A second pump 30 is also driven by motor 24 to supply pressurized hydraulic fluid for operation of the various hydraulic jacks or piston cylinder assemblies used in operating the forklift assembly 14.

The forklift assembly 14 of the present invention includes a mounting plate 31, having a U-shaped configuration that is pivotally mounted to the front end of frame 16. The frame front end includes a pair of forwardly extending arms 32 (one of which is illustrated in FIG. 2) each having a lugged end portion 34 with a bore therethrough. The lugged end portion 34 is closely spaced from the mounting plate 31. Pivotally mounted to the arms 32 in a manner explained later in greater detail, at spaced locations on the forklift assembly 14 are pairs of upstanding tilt bars 36 and 38 positioned thereon. Each tilt bar 36 and 38 of a pair of tilt bars is provided at its upper end portion with an aperture (not shown) such that all of said tilt bar apertures are in horizontal alignment. Pivotally affixed to each pair of tilt bars 36 and 38, at their respective pairs of apertures by a pin 40, is the piston rod end of one of a pair of tilt piston cylinder assemblies 42. The cylinder portion of each assembly 42, in turn, has a lug that is pivotally attached by a pin 44 to one of a pair of upstanding clevis bars 46 rigidly mounted on the front end of frame 16 in lateral, rearward alignment with a respective one of said tilt bar pairs. Pins 44 extend through horizontally aligned apertures (not shown) in clevis bars 46 at a lower elevation than the elevation of pins 40, such that, upon actuation of piston cylinder assemblies 42, pivotal movement of the pairs of tilt bars 36 and 38 about end portions 34 is established. Also shown interconnecting clevis bars 46 is a tie plate or tie bar 48 that extends upwardly from frame 16 to add additional strength and rigidity to the clevis bar assembly.

Rigidly affixed, as by welding, to the forward edges of the pairs of tilt bars 36 and 38, is the mounting plate 31 of the forklift assembly 14. The mounting plate 31 extends the full height of the tilt bars. The forklift assembly 14 includes a support plate 50 and an attachment lug 52 is rigidly secured, as by welding, at a substantially right angle to the upper edge of support plate 50. The attachment lug 52 extends rearwardly from the upper edge of the support plate 50 toward the mounting plate 31. The attachment lug 52 is provided with a bore 54 to permit connection of a lift device generally designated by the numeral 56 to the attachment lug 52. The lift device 56 is bolted, as will be explained later in greater detail, to the mounting plate 31.

The mounting plate 31 is essentially a U-shaped plate that extends transversely across the front end portion of the mobile frame 16. The plate 31 includes end portions 58 and 60 and an intermediate portion 62 with a pair of integral brace portions 64 extending between the end portions 58 and 60 and intermediate portion 62. The end portions 58 and 60 are rigidly secured to tilt bars 36 and 38. The intermediate portion 62 is positioned rearwardly and parallel to the end portions 58 and 60 to permit attachment of the forklift assembly 14 closely adjacent to the front axles 19 to thereby maintain the load carried by the forklift assembly 14 as close as possible to the front axles 19. This arrangement provides improved stability of the materials handling machine 10 particularly for materials handling machine having a frame 16 of increased length and a low profile as applicable with the machine 10 when used in underground mining operations for lifting and hauling of materials in a mine. The operation of the forklift assembly 14 is illustrated in FIG. 3 where the lift device 56 is operable to raise the forklift assembly from the position of FIG. 2 to an elevated position. Tilting of the unit 14 about its connection to arms 32 is accomplished by extension and retraction of the piston cylinder assemblies 42. Tilting may be carried out in either the raised position, as illustrated in phantom in FIG. 3, or when the forklift unit 14 is in a lowered position, as illustrated in FIG. 2.

Figure 6:
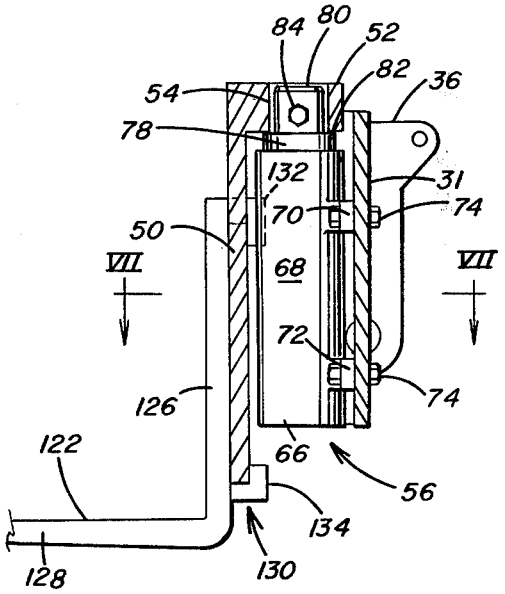
FIG. 6 is a fragmentary view taken along line VI—VI of FIG. 5 in side elevation of the lift device for raising and lowering the forklift assembly relative to the mobile frame, illustrating the connection of the lift device to the forklift assembly to prevent torsional loads from transferred to the lift device.
Figure 7:
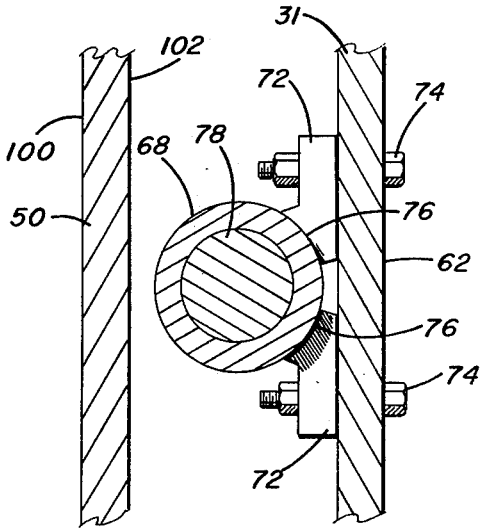
FIG. 7 is a fragmentary sectional view taken along line VII—VII of FIG. 6, illustrating the connection of the lift device to mounting plate that is pivotally connected to the mobile frame.

Preferably, the lift device 56 is a hydraulically operated piston cylinder assembly 66 and is illustrated in greater detail in FIG. 6. The cylinder portion 68 is securely mounted on the intermediate portion 62 of mounting plate 31 so as to closely position the assembly 66 to the front axles 19. Pairs of upper and lower brackets 70 and 72 are secured by bolts 74 to the intermediate portion 62. Each bracket includes a seat 76, as illustrated in FIG. 7, for receiving the cylinder portion 66 which, in turn, is welded to the plurality of bracket seats 76. A piston rod 78 is extensible and retractable out of and into the cylinder portion 68. The rod 78 has a reduced upper end portion 80 which forms annular shoulder 82 with the enlarged lower portion of rod 78.

Figure 5:
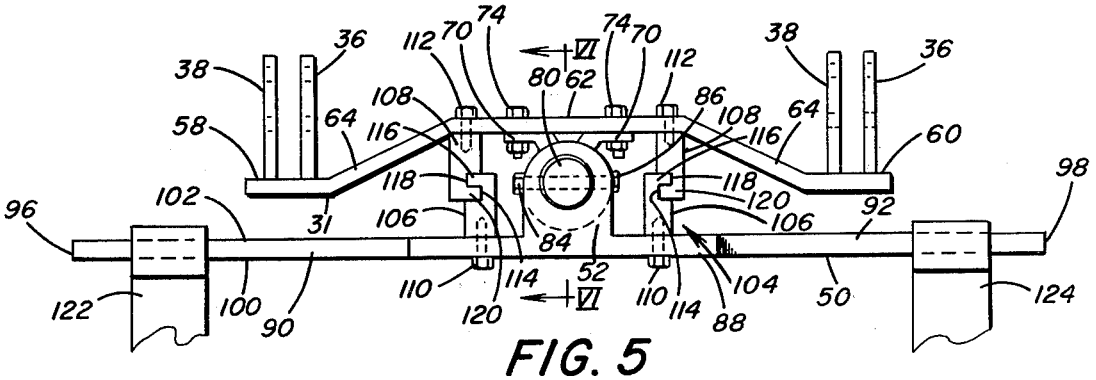
FIG. 5 is a fragmentary plan view of the connection of the forklift assembly to the mobile frame.

The piston rod 78 of the lift device 56 is connected to the support plate of the forklift assembly 14 by positioning the rod end portion 80 in the attachment lug bore 54 which has a diameter greater than the diameter of rod end portion 80. With this arrangement clearance is provided between the rod end portion 80 and lug bore 54 to provide a non-rigid connection between the piston rod 78 and the forklift assembly 14. The rod end portion 80 is maintained in lug bore 54 by a bolt 84 that passes through aligned bores in the rod end portion 80 and attachment lug 52. Nut 86 is threaded on the end of bolt 84 to maintain it in the bores. The rod end portion 80 is connected to lug 52 so that the lower surface of the lug 52 abuts the rod annular shoulder 82. With this arrangement the piston rod 78 carries only the vertical load transferred from the forklift assembly 14 and not the torsional load generated by the lifting and side forces imposed on the forklift tines 122 and 124, which are discussed later in greater detail, and then transferred to a guide assembly generally designated by the numeral 104 in FIG. 5 and imposed on the assembly 14. This prevents bending of the rod 78 and damage to the piston rod packing which results when torsional loads imposed on the forklift assembly 14 are transferred to the lift cylinder 56.

Figure 4:
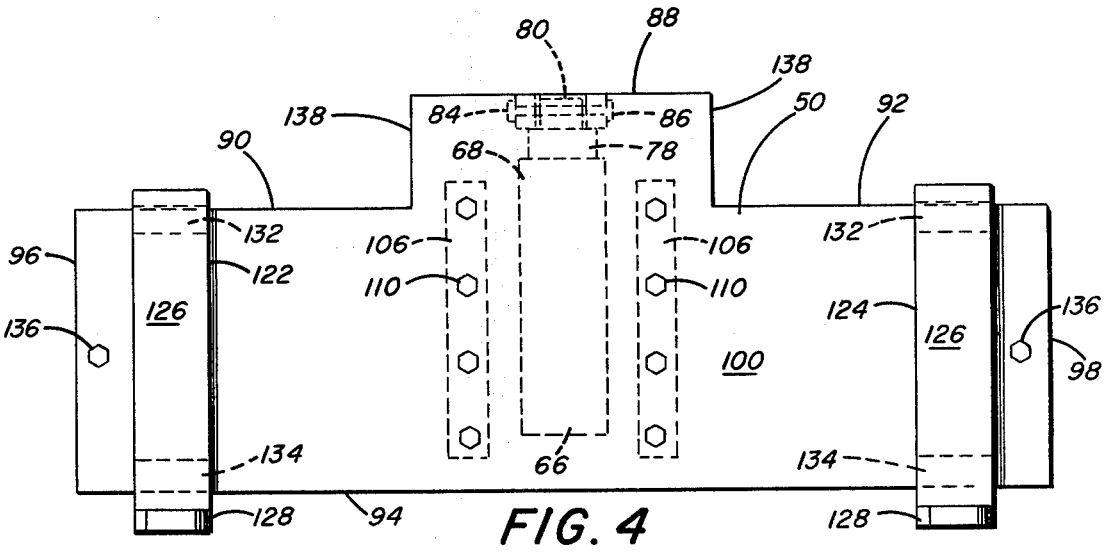
FIG. 4 is a front view of the forklift assembly, illustrating the tines carried by the assembly and a lift device, illustrated in phantom, for raising and lowering the assembly.

The support plate 50 of the forklift assembly 14 is positioned in spaced parallel relation to the mounting plate 31. The support plate 50 extends substantially the length of the transverse dimension of the transport unit 12. The support plate 50, as illustrated in FIG. 4, includes an upper horizontal surface 88 positioned above and between horizontal surfaces 90 and 92. A lower surface 94 extends continuously the length of the support plate 50. The vertical dimensions between the spaced parallel horizontal surfaces 88, 90–92 and 94 are of course variable. The support plate 50 is further defined by laterally spaced vertical edges 96 and 98 and front and rear vertical surfaces 100 and 102.

The attachment lug 52 is centrally welded to the support plate upper surface 88 and extends outwardly from the rear surface 102 toward the mounting plate 31. Positioned between and connected to the support plate rear surface 102 and the mounting plate 31 is a guide assembly generally designated by the numeral 104. The guide assembly 104 is operable to maintain vertical movement of the forklift assembly 14 relative to the mounting plate 31 and the frame 16. The guide assembly 104 is also operable to prevent torsional loads from being imposed on the piston rod 78 by the forklift assembly 14. The lifting and side forces generated by the torsional loads and imposed by the assembly 14 on the piston rod 78 are resisted by the guide assembly 104. Consequently, these forces are not carried by the piston rod 78.

The guide assembly 104 includes a first pair of elongated guide members 106 and a second pair of elongated guide members 108 where the guide members 106 and 108 are engagable for relative vertical movement therebetween. The first pair of guide members 106 are positioned oppositely of the lift device 56 and are secured by bolts 110, that extend through the support plate 50, to the rear surface 102 of plate 50. In a similar arrangement the second pair of guide members 108 are positioned oppositely of the lift device 56 and are secured by bolts 112, that extend through the mounting plate intermediate portion 62, to the forward face of the intermediate portion 62.

The guide members 106 each include elongated upright grooves 114 and tongues 116. The guide members 108 each include elongated upright grooves 118 and tongues 120. The tongues 116 engage the grooves 118 and the tongues 120 engage the grooves 114 in a manner to permit upward and downward linear movement of the guide members 106 on the guide members 108. Preferably, the upward and downward linear movement is in a vertical plane. Also means, such as a suitable lubricant, is provided for lubricating the engaging surfaces of the first and second guide member grooves 114 and 118 and tongues 116 and 120 respectively to reduce the frictional resistance between the engaging surfaces. Thus, upon actuation of the lift device 56, the guide members 106 and 108 maintain the forklift assembly 14 movable along a vertical linear path relative to the lift device 56.

The forklift assembly 14 includes a pair of tines 122 and 124 that are movably supported on the horizontal surfaces 90–92 and surface 94. Each of the tines 122 and 124 is substantially L-shaped and includes a vertical member 126 positioned in abutting relation with support plate front surface 100 and a horizontal member 128 extending forwardly from the lower end of vertical member 126. The tine members 128 are operable to receive and support the load carried by the forklift assembly 14. Each of the tines 122 and 124 is movably connected to the support plate 50 by a C-clamp mechanism generally designated by the numeral 130. The C-clamp mechanisms 130 each include a pair of angle members 132 and 134 welded to the tine vertical members 126. The angle members 132 and 134 are suitably secured to the vertical members 126, as by welding, to permit slidable movement of the tines on upper surfaces 90 and 92 of plate 50 and lower surface 94 of plate 50 respectively. With this arrangement the tines 122 and 124 are movable to a preselected location on the support plate 50 along the transverse length thereof and movable to a preselected distance apart.

In addition retaining bolts 136, as illustrated in FIG. 4, may be secured to the support plate front surface 100 adjacent the vertical edges 96 and 98 to retain the tines 122 and 124 on the support plate 50. With this arrangement each tine 122 and 124 is slidably movable to a preselected location on the support plate 50 between the respective retaining bolt 136 and a vertical edge 138 extending between horizontal surfaces 88 and 90–92.

Thus, it will be apparent with the present invention that by positioning the lift cylinder 56 closely adjacent to the front axles 19 by the configuration of the mounting plate 31, which reduces the longitudinal distance between the axles 19 and the forklift assembly 14, the stability of the machine 10 is improved particularly when heavy loads are carried by the forklift assembly 14. This makes the machine 10 particularly adaptable for use in underground mining operations in the handling and transporting of heavy equipment, such as compenents of a longwall system. Not only may greater loads be carried by the forklift assembly 14 of the present invention but torsional loads are prevented from being imposed on the piston rod 78 by the clearance fit of the rod end portion 80 with the attachment lug 52 and by the provision of the guide assembly 104 to insure upward and downward linear movement of the forklift assembly 14 on the mounting plate 31.

Thus, when the machine 10 is advanced with the tines 122 and 124 in the position illustrated in FIG. 2 into underlying relation with the materials to be transported and thereafter raised to an elevated position by the lift cylinder 56 as illustrated in FIG. 3, the only forces carried by the piston rod 78 are vertical forces transferred thereto by the assembly 14. The above discussed arrangement maintains the rod end portion 80 centrally positioned within the lug bore 54 so that bending or torsional forces are not transferred from the unit 14 to the piston rod 78. Accordingly, the unit 14 may be tilted backwardly by operation of piston cylinder assemblies 42 to facilitate tramming of a loaded forklift assembly 14.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A mobile materials handling machine comprising, a mobile frame having traction means including a front axle positioned at a front end portion of said mobile frame, a mounting plate pivotally connected to said mobile frame, said mounting plate extending transversely across said front end portion of said mobile frame, said mounting plate including a pair of end portions and an intermediate portion therebetween, said pair of end portions being pivotally connected to said mobile frame to facilitate pivotal movement of said mounting plate about a transverse horizontal axis relative to said mobile frame, said intermediate portion being displaced rearwardly of said pair of end portions toward said mobile frame front end portion so that said intermediate portion is positioned closer to said front axle than said pair of end portions, a forklift assembly positioned forwardly of said mounting plate and connected to said mounting plate to facilitate vertical movement of said forklift assembly relative to said mounting plate, a piston cylinder assembly secured to said mounting plate intermediate portion, a piston rod operable to extend and retract relative to the upper end of said piston cylinder assembly, said forklift assembly having a rearwardly extending attachment lug with a bore therethrough for receiving the upper end of said piston rod, said piston rod having a shoulder portion adjacent the upper end thereof for supporting said attachement lug, said attachment lug bore having a diameter greater than the diameter of the upper end of the piston rod so that said attachment lug is movable relative to the piston rod to assist in preventing the torsional forces carried by said forklift assembly from being transferred to said piston rod and said piston cylinder assembly, connecting means for connecting the end of said piston rod to said attachment lug so that said attachment lug is movable on said piston rod shoulder portion and upon actuation of said piston cylinder assembly said piston rod is operable to extend and retract to thereby vertically raise and lower said forklift assembly relative to said mobile frame, and said piston cylinder assembly being positioned between said forklift assembly and said mounting plate intermediate portion so that said piston cylinder assembly is located closely adjacent to said front axle to thereby closely position the load carried by said forklift assembly to said front axle.

2. A mobile materials handling machine as set forth in claim 1 which includes, pivot actuating means secured to said mobile frame front end portion and connected to said mounting plate end portions for pivoting said mounting plate and said forklift assembly secured thereto about said transverse horizontal axis.

3. A mobile materials handling machine as set forth in claim 2 in which said pivot actuating means includes, a pair of piston cylinder assemblies having extensible piston rods, said piston rods being connected to said mounting plate end portions, and said piston cylinder assemblies being connected to said mobile frame front end portion at an elevation below the connection of said piston rods to said mounting plate end portions so that upon retraction of said piston rods said forklift assembly pivots about said transverse horizontal axis and moves upwardly and backwardly toward said mobile frame front end portion.

4. A mobile materials handling machine as set forth in claim 1 which includes, guide means connected at one end to said mounting plate and at the opposite end to said forklift assembly to maintain vertical movement of said forklift assembly relative to said mounting plate and said mobile frame.

5. A mobile materials handling machine as set forth in claim 4 in which said guide means includes, a first elongated guide member secured to said mounting plate, said first guide member having an elongated upright groove and a tongue extending substantially the length of said groove, a second elongated guide member secured to said forklift assembly, said second guide member having an elongated upright groove and a tongue extending substantially the length of said groove, said first guide member groove arranged to receive said second guide member tongue and said second guide member groove arranged to receive said first guide member tongue to thereby permit vertical relative movement between said first and second guide members.

6. A mobile materials handling machine as set forth in claim 1 which includes, said mounting plate intermediate portion being positioned closely adjacent to said front axle and rearwardly of said mounting plate end portions, said end portions extending parallel to said intermediate portion and spaced laterally therefrom, a pair of brace portions formed integral with said mounting plate, and said pair of brace portions connected at one end to said intermediate portion on opposite sides of said lift means and extending angularly from intermediate portion for connection to said pair of end portions respectively to thereby provide said mounting plate with a configuration adapted for mounting said forklift assembly closely adjacent to said front axle and thereby reduce the moment of the forces of the forklift assembly on said front axle.

7. A mobile materials handling machine as set forth in claim 1 which includes, pivot means pivotally connecting said mounting plate end portions to said mobile frame front end portion to thereby pivotally connect said forklift assembly to said mobile frame, and said pivot means being positioned below the connection of said pivot actuating means to said mobile frame front end portion.

8. A forklift assembly comprising, a mounting plate having an intermediate portion positioned between and rearwardly of a pair of end portions, a forklift unit positioned forwardly of said mounting plate with said pair of end portions being positioned closer to said forklift unit than said intermediate portion, a piston cylinder assembly secured to said mounting plate intermediate portion, a piston rod operable to extend and retract relative to the upper end of said piston cylinder assembly, said forklift unit having a rearwardly extending attachment lug with a bore therethrough for receiving the upper end of said piston rod, said piston rod having a shoulder portion adjacent the upper end thereof for supporting said attachment lug, said attachment lug bore having a diameter greater than the diameter of the upper end of the piston rod so that said attachment lug is movable relative to the piston rod to assist in preventing the torsional forces carried by said forklift unit from being transferred to said piston rod and said piston cylinder assembly, and connecting means for connecting the end of said piston rod to said forklift unit so that said attachment lug is movable on said piston rod shoulder portion and upon actuation of said piston cylinder assembly said piston rod is operable to extend and retract to thereby vertically raise and lower said forklift unit relative to said mounting plate.

9. A forklift assembly as set forth in claim 8 which includes, guide means connected at one end to said mounting plate and at the opposite end to said forklift unit to maintain vertical movement of said forklift unit relative to said mounting plate.

10. A forklift assembly as set forth in claim 9 in which said guide means includes, a first elongated guide member secured to said mounting plate, said first guide member having an elongated upright groove and a tongue extending substantially the length of said groove, a second elongated guide member secured to said forklift assembly, said second guide member having an elongated upright groove and a tongue extending substantially the length of said groove, said first guide member groove arranged to receive said second guide member tongue and said second guide member groove arranged to receive said first guide member tongue to thereby permit vertical relative movement between said first and second guide members.

11. A forklift assembly as set forth in claim 8 which includes, said mounting plate intermediate portion being positioned closely adjacent to said lift means, said mounting plate end portions extending parallel to said intermediate portion and spaced laterally therefrom, and said mounting plate including a pair of brace portions connected at one end to said intermediate portion on opposite sides of said lift means and extending angularly from said intermediate portion for connection to said pair of end portions respectively to thereby provide said mounting plate with a configuration adapted for mounting said forklift unit closely adjacent to said mounting plate.

* * * * *